United States Patent [19]

Sakai

[11] Patent Number: 4,972,676

[45] Date of Patent: Nov. 27, 1990

[54] REFRIGERATION CYCLE APPARATUS HAVING REFRIGERANT SEPARATING SYSTEM WITH PRESSURE SWING ADSORPTION

[75] Inventor: Takeshi Sakai, Hiratsuka, Japan

[73] Assignee: Kabushiki Kaisha Toshiba, Kawasaki, Japan

[21] Appl. No.: 451,305

[22] Filed: Dec. 15, 1989

[30] Foreign Application Priority Data

| | | | |
|---|---|---|---|
| Dec. 23, 1988 | [JP] | Japan | 63-324932 |
| Mar. 31, 1989 | [JP] | Japan | 1-83502 |
| Mar. 31, 1989 | [JP] | Japan | 1-83503 |

[51] Int. Cl.[5] ..... F25J 3/00

[52] U.S. Cl. ..... 62/18; 62/114; 62/512

[58] Field of Search ..... 62/114, 512, 18

[56] References Cited

U.S. PATENT DOCUMENTS

| | | | |
|---|---|---|---|
| 4,580,415 | 4/1986 | Sakuma et al. | 62/512 |
| 4,781,738 | 11/1988 | Fujiwara et al. | 62/18 |

FOREIGN PATENT DOCUMENTS

| | | |
|---|---|---|
| 38-23928 | 11/1963 | Japan . |
| 38-25969 | 12/1963 | Japan . |
| 59-197761 | 11/1984 | Japan . |
| 62-80452 | 4/1987 | Japan . |
| 62-162853 | 7/1987 | Japan . |

*Primary Examiner*—Ronald C. Capossela

*Attorney, Agent, or Firm*—Cushman, Darby & Cushman

[57] ABSTRACT

In order to provide a refrigeration cycle of a heat pump type, a refrigeration cycle circuit circulates a mixed refrigerant, including of a high boiling point refrigerant and a low boiling refrigerant and filled with a predetermined concentration ratio, at least through a compressor, a condenser and an evaporator. A refrigerant separation system comprises an adsorbing section for separating one of the high and low boiling point refrigerants from the mixed refrigerant circulating by the refrigeration cycle circuit by using a pressure swing adsorption method, a reservoir section for temporarily reserving the separated refrigerant and a returning section for returning that refrigerant which remains without being separated by the adsorbing section and without being reserved in the reserving section to the refrigeration cycle circuit.

20 Claims, 8 Drawing Sheets

REFRIGERATION CYCLE APPARATUS HAVING REFRIGERANT SEPARATING SYSTEM WITH PRESSURE SWING ADSORPTION

BACKGROUND OF THE INVENTION

1. Field of the Invention

The present invention generally relates to a refrigeration cycle apparatus, and, more particularly, to an improvement of a refrigerant separation system for varying the composition of a mixed refrigerant that circulates in a refrigeration cycle circuit in a refrigeration cycle apparatus in which a non-azeotropic mixed refrigerant consisting of plural types of refrigerants with different boiling points is filled.

2. Description of the Related Art

Recently, there is a demand for an air conditioner which uses heat attained by a heat pump type refrigeration cycle apparatus to ensure supply of hot water in addition to heating by a radiation panel that quickens the rising of heating as compared with the normal heating.

Conventionally, the above refrigeration cycle apparatus used in an air conditioner utilizes a single-component refrigerant, such as chloro-fluoro-carbon represented by R-22 having a relatively low boiling point, as being suitable for high efficiency operation. Since such a refrigeration cycle apparatus has a low condensing temperature, its performance is insufficient to satisfy the above demand. It is therefore desirable to develop a refrigeration cycle apparatus which is capable of functioning at high efficiency in a heating operation when a high temperature is required for supplying hot water, for example.

To fulfill this demand, recently a refrigeration cycle apparatus has been developed which has a mixed refrigerant consisting of plural types of refrigerants (normally, two types of refrigerants, namely, a high boiling point refrigerant and normal (low boiling point) refrigerant) filled in a refrigeration cycle circuit and can change the composition of the mixed refrigerant that circulates in this refrigeration cycle in accordance with the operational goal, as disclosed in Published Unexamined Japanese Applications No. 62-80452 and No. 59-197761. In other words, this refrigeration cycle apparatus can vary the composition (concentration) of a refrigerant which can increase the condensing temperature in a high temperature operation.

Varying the composition of a mixed refrigerant necessitates separation of a certain types of refrigerant from the mixed refrigerant as quick as possible, so that the concentration of a high boiling point refrigerant is high in the high temperature operation and, the concentration of a low boiling point refrigerant is high in the normal operation.

In the above-developed refrigeration cycle apparatus, a refrigerant separation system that is considered typical, is a separation method using distillation, which cools vapor of various types of refrigerants produced by heating a mixed refrigerant by means of a heating source to thereby restore it in liquid form for separation of a refrigerant.

The separation method using distillation requires a distiller taller than a certain height in order to provide high separation efficiency. Realizing this efficiency should inevitably result in enlargement of the refrigerant separation system and thus the overall refrigeration cycle apparatus. Further, this refrigeration cycle apparatus requires a heating source exclusively provided by disposing a heating pipe from the refrigeration cycle circuit or newly disposing a heater. In addition, this refrigeration cycle apparatus needs energy to be supplied to such a heating source and has no simple structure.

There is another known refrigerant separation system as disclosed in Published Unexamined Japanese Patent Application No. 62-162853, which separates a refrigerant by the thermal swing adsorption (TSA) method using an adsorbent material. In other words, the refrigeration cycle apparatus equipped with a refrigerant separation system employing the TSA method adsorbs a certain type of refrigerant in an adsorbent tank directly provided in a refrigeration cycle circuit and desorps the absorbed refrigerant by applying heat from a heater, to thereby vary the concentration of the refrigerant circulate in the refrigeration cycle circuit.

Based on this refrigerant separation system employing the TSA method, however, adsorption of a low boiling point refrigerant is done only by the adsorbent tank. This would require a significant amount of an adsorbent material filled in the adsorbent tank and enlarge the adsorbent tank and thus the overall refrigeration cycle apparatus, so that the refrigeration cycle apparatus is impractical for use in a home air conditioner or the like. Assuming that the pressure in the adsorbent tank of this refrigeration cycle apparatus is 6 $Kg/cm^2$ (absolute pressure) and the refrigerant temperature is $-5°$ C., the amount of a filled adsorbent material necessary for changing the mixed refrigerant concentration ratio R-22/R-114=50 mol%/50 mol% (504 g/996 g) suitable for high temperature operation to a different concentration ratio R-22/R-114=80 mol%/20 mol% suitable for high efficiency operation by absorbing R-114, would be 967 g. Since the amount of the filled absorbent material is in proportional to the pressure in the adsorbent tank, it can be decreased by increasing the pressure in the adsorbent tank. The reduction in the amount of the filled adsorbent material is however restricted by the proper scale of the overall apparatus.

SUMMARY OF THE INVENTION

Accordingly, it is an object of this invention to provide a new and improved refrigeration cycle apparatus having a function for changing composition of a circulation mixed refrigerant by a pressure swing adsorption (PSA), which contributes to making the apparatus compact and separates a specific refrigerant for high efficiency to thereby ensure a high efficiency (performance) operation and a high temperature operation.

According to the first aspect of the present invention, there is provided a refrigeration cycle apparatus comprising:

refrigeration cycle circuit means for permitting a mixed refrigerant including a high boiling point refrigerant and a low boiling point refrigerant adapted to be filled having a predetermined concentration ratio to circulate at least through a compressor, a condenser and an evaporator, to thereby provide a refrigeration cycle of a heat pump type; and refrigerant separating means having adsorbing means for separating one of the high boiling point refrigerant and the low boiling point refrigerant from the mixed refrigerant to be circulated by the refrigeration cycle circuit means by a pressure swing adsorption method, reservoir means for temporarily reserving the refrigerant separated by the adsorbing means, and means for returning that remaining refrigerant which is not separated by the adsorbing means and is not reserved by the reservoir means, to the refrigeration cycle circuit means.

According to the second aspect of the present invention, there is provided a refrigeration cycle apparatus having a refrigerant separation system comprising:

an adsorbent material for adsorbing a specific type of refrigerant in a mixed refrigerant;

a first flow path, coupled to a high pressure side of a refrigeration cycle circuit, for leading that mixed refrigerant on the high pressure side to the adsorbent material for adsorption of the specific type of refrigerant;

a second flow path, coupled to the adsorbent material, for returning that refrigerant which passes through the second flow path without being adsorbed, to the refrigeration cycle circuit;

a third flow path, coupled to the adsorbent material, for depressurizing the adsorbent material and desorbing a refrigerant from the adsorbent material;

a switching valve for alternately switching between the first and third flow paths; and reservoir means, coupled to the third flow path, for reserving the desorbed refrigerant.

According to the third aspect of the present invention, there is provided a refrigeration cycle apparatus having a refrigerant separation system comprising:

an adsorbent material for adsorbing a high boiling point refrigerant in a mixed refrigerant;

a refined gas outlet disposed below the adsorbent material, from which refined gas from the adsorbent material flows out;

a first flow path, coupled to a gas-liquid separator of a refrigeration cycle circuit, for leading a refrigerant to the adsorbent material for adsorption of a high boiling point refrigerant;

a second flow path, coupled to the adsorbent material, for returning that refrigerant which passes through the second flow path without being adsorbed, to the refrigeration cycle circuit;

a third flow path, coupled to the refined gas out let of the adsorbent material, for depressurizing the adsorbent material and desorbing the high boiling point refrigerant from the adsorbent material;

a switching valve for alternately switching between the first and third flow paths; and reservoir means, disposed downstream of the adsorbent material, for reserving the high boiling point refrigerant flowing through the third flow path.

According to the fourth aspect of the present invention, there is provided a refrigeration cycle apparatus having a refrigerant separation system comprising:

an adsorbent material for adsorbing a high boiling point refrigerant in a mixed refrigerant;

a first flow path, coupled to a liquid outlet of a gas-liquid separator of a refrigeration cycle circuit, for leading a liquid-phase refrigerant to the adsorbent material for adsorption of the high boiling point refrigerant;

a second flow path, coupled to the adsorbent material, for returning that refrigerant which passes through the second flow path without being adsorbed, to the refrigeration cycle circuit;

a third flow path, coupled to the adsorbent material, for depressurizing the adsorbent material and desorbing the high boiling point refrigerant from the adsorbent material;

a switching valve for alternately switching between the first and third flow paths;

heat exchanging means having a radiator section provided in the third flow path and a heat receiving section provided in the first flow path in communication with the radiator section, for supplying heat of evaporation to a refrigerant flowing through the first flow path; and reservoir means, coupled to the third flow path, for reserving the desorbed high boiling point refrigerant.

According to the fifth aspect of the present invention, there is provided a refrigeration cycle apparatus having a refrigerant separation system comprising:

an adsorbent material for mainly affecting a specific type of refrigerant of a mixed refrigerant;

a first flow path for leading that refrigerant on a high pressure side of a refrigeration cycle circuit to the adsorbent material for adsorption of the specific type of refrigerant;

a second flow path for permitting the adsorbent material to communicate with a low pressure side of the refrigeration cycle circuit, desorbing a refrigerant from the adsorbent material through depressurization, and returning the desorbed refrigerant to the refrigerant cycle circuit;

a switching valve for alternately switching between the first and second flow paths; and reservoir means, coupled to the adsorbent material, for reserving that type of refrigerant which is not adsorbed by the adsorbent material.

According to the arrangement of the above-described first aspect of the present invention, one of the constituting refrigerants of a mixed refrigerant circulating in the refrigeration cycle circuit means is separated and reserved by refrigerant separating means by means of the PSA method. The concentration ratio of the constituting refrigerants can be changed to a value corresponding to the purpose for using this apparatus. Since the refrigerant separating means employing the PSA method repeats adsorption and desorption (reservoir) in a predetermined cycle, the overall apparatus can be made more compact as compared with the apparatus using the TSA method.

According to the second aspect, the switching valve, which alternately switches between the first and third flow paths, permits a specific type of refrigerant contained in a mixed refrigerant to be adsorbed by an adsorbent material and further desorbed therefrom to be reserved in the reservoir means. That refrigerant which passes without being adsorbed by the adsorbent material returns to the refrigeration cycle circuit. This ensures separation of a refrigerant necessary for changing the composition for high efficiency operation and a high temperature operation without needing a large distiller or adsorbent tank.

According to the third aspect, the switching valve, which alternately switches between the first and third flow paths, permits that mixed refrigerant which is mainly of a high boiling point type to be adsorbed by an adsorbent material and further desorbed therefrom to be reserved in the reservoir means. That refrigerant which is mainly of a low boiling point type and passes without being adsorbed by the adsorbent material, returns to the refrigeration cycle circuit. This ensures separation of a refrigerant necessary for changing the composition for high efficiency operation and a high temperature operation without needing a large distiller or adsorbent tank, as per the first aspect of the present invention. The high boiling point refrigerant is partially liquefied by an increase in concentration in a separation step, and this portion may remain somewhere in its circulation path and may not flow in the reservoir means. Since the refined gas outlet of the adsorbent material is disposed at a lower portion and the reservoir means is provided downstream of the adsorbent material (both being disposed in the gravitational direction), therefore, the high boiling point refrigerant even liquefied can be recovered in the reservoir means without remaining in the circulation path.

According to the fourth aspect, the switching valve, which alternately switches between the first and third flow paths, permits that mixed refrigerant which is mainly of a high boiling point type to be adsorbed by an adsorbent material and further desorbed therefrom to be reserved in liquefied form in the reservoir means. That refrigerant which is mainly of a low boiling point type and passes without being adsorbed by the adsorbent material, returns to the refrigeration cycle circuit. Heat generated at a time the high boiling point refrigerant is reserved in liquefied form is supplied to the heat receiving section through a radiator section, thereby evaporating the refrigerant flowing out from the gas-liquid separator. This ensures separation of a refrigerant necessary for changing the composition for high efficiency operation and a high temperature operation without needing a large distiller or a heating source that requires excess energy, as per the first aspect of the present invention. Further, since the heat generated from the high boiling point refrigerant at a time the refrigerant is reserved in liquefied form is supplied as heat for gasifying the refrigerant from the gas-liquid separator, the adsorption pressure can be increased while suppressing heat loss and the separation efficiency can be effectively enhanced.

According to the fifth aspect, the switching valve, which alternately switches between the first and second flow paths, permits a specific type of refrigerant contained in a mixed refrigerant to return to the refrigeration cycle circuit after undergoing a step of adsorption to an adsorbent material and a step of desorption from the adsorbent material. That type of refrigerant which is not adsorbed by the adsorbent material is reserved in the reservoir means. This ensures separation of a refrigerant necessary for changing the composition for high efficiency operation and a high temperature operation without along distiller or adsorbent tank, which result in enlargement of the overall apparatus.

Additional objects and advantages of the invention will be set forth in the following description, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

FIGS. 1 through 3 illustrate the first embodiment of this invention in which:

FIG. 1 is a schematic structural diagram illustrating a refrigeration cycle apparatus embodying this invention together with a one bed type refrigerant separation system that is highly dependable on the physical and chemical adsorptive force of an adsorbent material, FIG. 2 is a linear diagram illustrating an adsorption characteristic of an adsorbent material (activated alumina) of an adsorbent tower, and FIG. 3 is a timing chart illustrating the operational timings of two valves for adsorption/separation of a refrigerant;

DETAILED DESCRIPTION OF THE PREFERRED EMBODIMENTS

Figure 1:
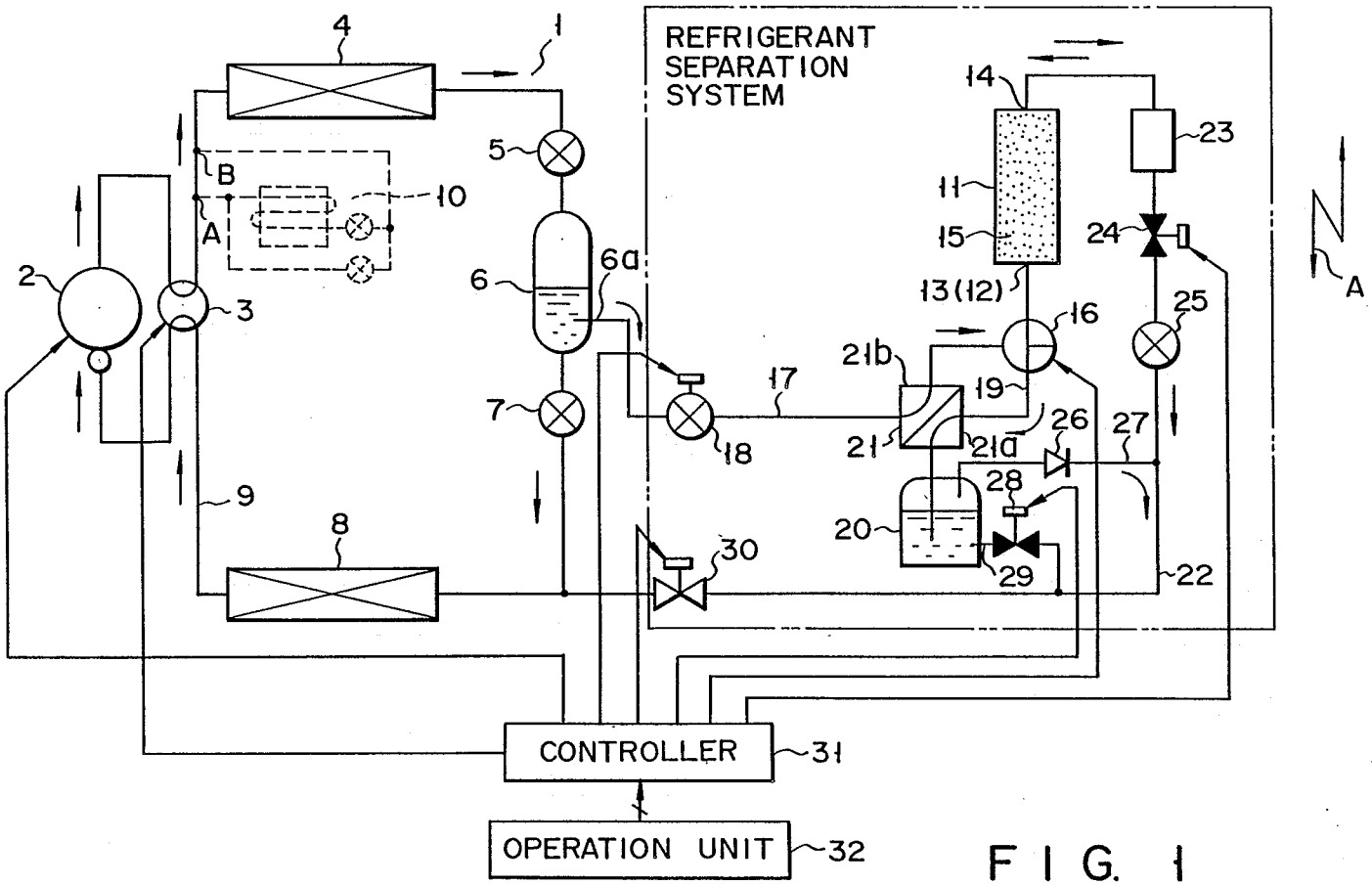

Reference will now be made in detail to the presently preferred embodiments of the invention as illustrated in the accompanying drawings, in which like reference characters designate like or corresponding parts throughout the drawings.

To begin with, a description will be given of the principle of a refrigerant separation system using the PSA method, which is employed in a refrigeration cycle apparatus of the present invention.

The PSA-method-based refrigerant separation system employed in this invention has an adsorbent material of a specific type of refrigerant and reservoir means, alternately repeats adsorption and desorption in a predetermined cycle changing the pressure to the adsorbent material, and stores, for example, a desorbed refrigerant in the reservoir means, thereby changing the composition of the refrigerant circulating in a refrigeration cycle circuit. For instance, with respect to a mixed refrigerant consisting of a low boiling point refrigerant and a high boiling point refrigerant which are filled in the refrigeration cycle circuit with a predetermined initial concentration ratio suitable for a high efficiency operation, the PSA-method-based refrigerant separation system mainly separates and reserves the low boiling point refrigerant for a high temperature operation so that flowing in the refrigeration cycle circuit is a mixed refrigerant which contains the high boiling point refrigerant having a higher concentration than the initial one. It is therefore possible to realize a refrigeration cycle apparatus which can increase the condensing temperature to fulfill the requirement of executing high temperature heating and hot-water supply using a radiation panel.

In this case, since the PSA-method-based refrigerant separation system repeats adsorption and desorption (reserving) in a predetermined cycle, it is possible in principle to reduce the amount of an adsorbent material filled to thereby effectively contribute to making the overall apparatus compact.

[FIRST EMBODIMENT]

Figure 2:
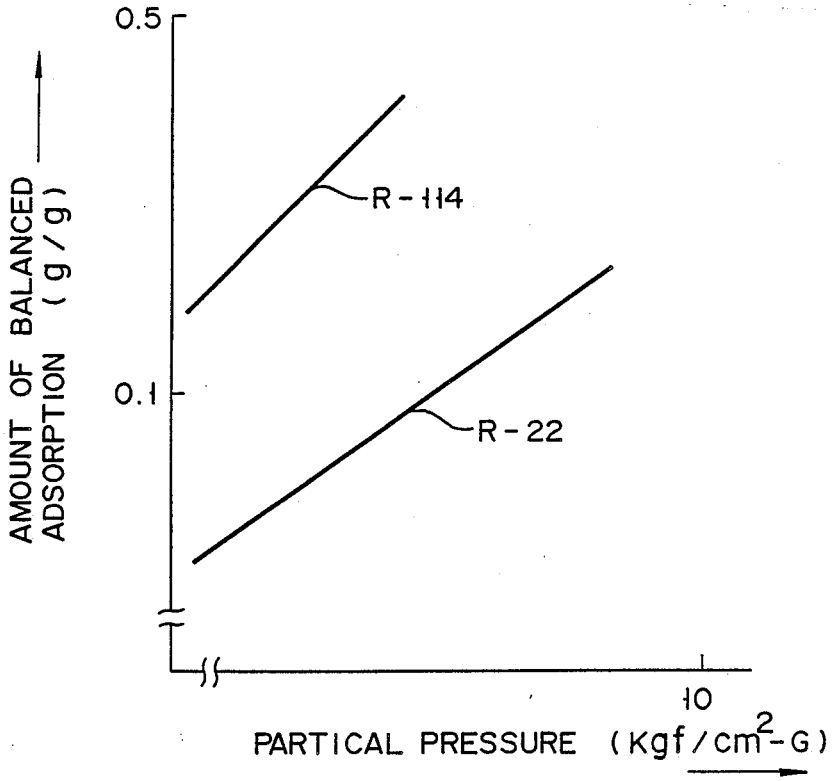
Figure 3:
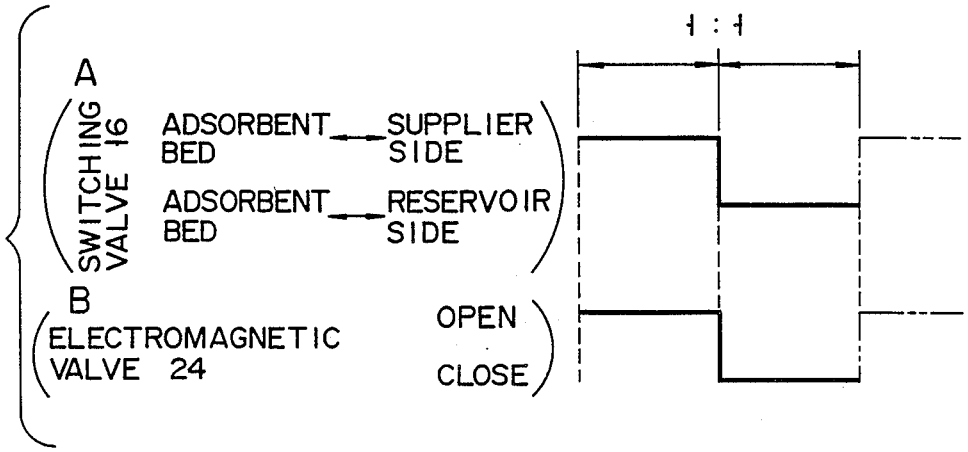

The first embodiment of the present invention will be described below referring to FIGS. 1 through 3. FIG. 1 illustrates a refrigeration cycle apparatus of a heat pu type e'd4.Cqxc'6vfFFvfW'P&fw'WWFRb&VfW&Vf6RF-VfwFW2&Vg&vW&FvP&76FR6&7VBbF26&7VB2-6vg7FGWFVB'P&6vffV7FfrfwW'WvfGfR2fw'7vF6-fr&WGvVVP&6vvFfrfBVFfrBbgFW&fBVBW6fvW-'P'6w'&W7vfFfrFr6vfFVg6W'BbWg6vbfGfRPP'6w'-&W7vfFfrFrFW&W77W&&frVfBBv2FVP'6W&Fw'-bBbWg6vbfGfRr6w'&W7vfFfrF P'FRFW&W77W&&frVfBfBbWFW&fl heat exchanger 8 (corresponding to a vaporizer) in order to a compressor 2 of, for example, enclosed type through a refrigerant pipe 9. The refrigeration cycle circuit 1 is filled with a mixed refrigerant consisting of, for example, "R-22(53 mol%)," a refrigerant having a low boiling point, and "R-114 (47 mol%)," a refrigerant having a high boiling point.

Referring to FIG. 1, numeral 11 denotes an adsorbent tower (corresponding to an adsorbent material) constituting a refrigerant separation system. The adsorbent tower 11 has a refined gas outlet 13 serving also as a supplying gas inlet 12 provided at the bottom (lower side in the diagram) and an exhaust gas outlet 14 provided at the top (upper side in the diagram). The adsorbent tower 11 is filled with an activated alumina with a main minute aperture diameter of 100Å, for example, which serves as an adsorbent to adsorb "R-114" in the mixed refrigerant by priority and has a high balanced adsorption characteristic to "R-114." FIG. 2 presents the balanced adsorption characteristic of the activated alumina 15, showing the "R-114" component in contrast to the "R-22" component.

The refined gas outlet 13 of the adsorbent tower 11 is coupled to a switching valve 16 constituted by a three-way valve for switching between refrigerant supply and reservoir. One port of the valve 16 is coupled to a liquid outlet 6a of the gas-liquid separator 6 through a mixed refrigerant supplying pipe 17 (corresponding to the first flow path).

Reference 18 in FIG. 1 is an amount-of-supply regulator disposed in the pipe 17 and constituted by a depressurizing valve, for example.

Another port of the three-way valve 16 is coupled through a refined refrigerant reservoir pipe 19 (corresponding to the third flow path) to a refrigerant reservoir tank 20 (corresponding to the reservoir means) disposed downstream (in the gravitational direction) of the adsorbent tower 11.

As will be described later, therefore, setting the valve 16 to the "gas-liquid separator 6←adsorbent tower 11" side permits the mixed refrigerant on the high pressure side of the refrigeration cycle circuit 1 to flow to the adsorbent tower 11 and permits the activated alumina 15 to adsorb the "R-114 " component of the mixed refrigerant.

Switching the valve 16 to the "adsorbent tower 11 reservoir tank 20" side depressurizes the activated alumina 15 to desorb the adsorbed "R-114" component so that this component can flow in the reservoir tank 20.

A heat exchanger 21 (corresponding to the heat exchanging means) for vaporization and condensation is provided in a midway of the aforementioned pipes 17 and 19. The heat exchanger 21 has a radiator section 21a coupled to the pipe 19 at its heat exchanging section. The heat exchanger 21 further has a heat receiving section 21b connected through the valve 16 to the pipe 17 and the radiator section 21a; this section 21b has the same structure as the radiator section 21a. This arrangement permits the heat generated in a step for reserving the "R-114 " component to be utilized to vaporize a liquid-phase refrigerant from the gas-liquid separator 6 and cools the "R-114 " component desorbed from the adsorbent bed 11 to promote condensation (liquefied recovery).

The exhaust gas outlet 14 of the adsorbent tower 11 is coupled to one end of a return pipe 22 (corresponding to the second flow path). The other end portion of the pipe 22 is coupled to a refrigerant distributing pipe section between the expansion valve 7 and the external heat exchanger 8, which are on the low pressure side of the refrigeration cycle circuit 1. This pipe 22 is provided with a purging tank 23, an electromagnetic valve 24 and a flow regulator 25 serving as a resistor for controlling the amount of a returning refrigerant in order from the side of the adsorbent tower 11. The flow regulator 25 may be constituted by a depressurizing valve. The tank 23 has a volume about 2/5 times that of the adsorbent tower 11, for example. A gas component return pipe 27 having a check valve 26 disposed between the flow regulator 25 and the reservoir tank 20 is coupled to that portion of the pipe 22 on the downstream side of the flow regulator 25.

This pipe 27 serves to return a gaseous-phase refrigerant in the reservoir tank 20 to the refrigeration cycle circuit 1 to thereby increase the purity of the "R-114 " component in the tank 20.

A liquid-phase refrigerant pipe 29 having an electromagnetic valve 28 disposed between the flow regulator 25 and the reservoir tank 20 is also coupled to that portion of the pipe 22 on the downstream side of the flow regulator 25. This arrangement permits the "R-114" component in the reservoir tank 20 to return to the refrigeration cycle circuit 1 as desired.

Reference numeral 30 in FIG. 1 is an electromagnetic valve provided at the end of the pipe 22 on the downstream side for a return of the refrigeration cycle.

Reference numeral 31 in FIG. 1 is a controller (comprising a microcomputer and the peripheral circuits). This controller 31 has an input section coupled to an operation unit 32, and an output section coupled to the switching valve 16 and electromagnetic valve 24. With this arrangement, upon reception of an operation signal from the operation unit 32 which instructs to vary the composition, the controller 31 alternately switches the switching valve 16 between the pressurizing side (supply side; on the side of the gas-liquid separator 6) and the depressurizing side (reservoir side; on the side of the reservoir tank 20) for each predetermined period (for example, in the order of several seconds) in the ratio of 1:1 (see FIG. 3). At the same time, the controller 31 sets the electromagnetic valve 24 to the "open" side when pressure is increased and to the "close" side when pressure is decreased, in association with the switching of the valve 16. Controlling these valves, the controller 31 executes a refrigerant separating step of alternately repeating adsorption and desorption of the aforementioned specific type of refrigerant. It should be noted that the controller 31 sets the flow regulator 18 and electromagnetic valve 30 to the "open" side during this refrigerant separating step The controller 31 is also coupled with the enclosed type compressor 2, four-way valve 3 and electromagnetic valve 28 and controls the individual units in accordance with setting data input from the operation unit 32.

The arrow A in FIG. 1 indicates the gravitational (vertical) direction.

In executing a high temperature heating operation through manipulation of the operation unit 32 in the above refrigeration cycle apparatus of an air conditioner, the flow regulator 18 and electromagnetic valve 30 are set to the "close" side and the four-way valve 3 is set to the heating side in accordance with the setting data entered via the operation unit 32. Then, the enclosed compressor 2 starts functioning so that the mixed refrigerant sent out from the compressor 2 flows through the internal heat exchanger 4, expansion valve 5, gas-liquid separator 6, expansion valve 7 and external heat exchanger 8 in the named order. In other words, a heating cycle is formed and a high temperature operation is performed using a mixed refrigerant with a composition ratio of "R-22"/"R-114"=53 mol%/47 mol%.

When the operation unit 32 is operated to change the temperature-significant operation to an efficiencysignificant operation, the flow regulator 18 and electromagnetic valve 30 are set to the "open" side by a command from the controller 31. And, the switching valve 16 and electromagnetic valve 24 are alternately switched for every predetermined period as indicated by the timing chart in FIG. 3, thereby separating the "R-114" component from the mixed refrigerant in the refrigeration cycle circuit 1.

With reference to the separating step, of a gaseous-phase refrigerant containing a high-concentration "R-22" and a low-concentration "R-114" and a liquid-phase refrigerant containing a low-concentration "R-22" and a high-concentration "R-114," the latter refrigerant flows through the pipe 17 when the switching valve 16 is set to the side for permitting the gas-liquid separator 6 to communicate with the adsorbent tower 11. When the liquid-phase refrigerant having a low boiling point component condensed at a high concentration passes through the pipe 17 and further through the heat receiving section 21*b*, its heat is exchanged with external heat (to be described later) produced at a time the "R-114" component is reserved, and is vaporized. As a result, the liquid-phase refrigerant is gasified and pressure is significantly increased. The gasified, high-pressure refrigerant is supplied to the supply gas inlet 12 (same as the refined gas outlet 13) of the adsorbent tower 11. Accordingly, the "R-114" component of the mixed refrigerant is sequentially adsorbed by the active alumina 15 by priority. That refrigerant which mainly contains the "R-22" component and passes through the activated alumina 15 without being adsorbed, returns to the low-pressure side of the refrigeration cycle circuit passing through the return pipe 22.

When the adsorption step continues for a predetermined time, the switching valve 16 is set to the side for permitting the adsorbent tower 11 to communicate with the reservoir tank 20, by a command from the controller 31. This depressurizes the activated alumina 15 so that the refrigerant mainly containing the "R-114" component, adsorbed in the previous adsorbing step, is desorbed from the activated alumina 15.

At a time of desorption, the pressure of the refrigerant (having an "R-22" component of a high concentration) stored in the tank 23 in the above adsorbing step flows in the reverse direction to the adsorbent tower 11 to increase the partial pressure in the tower 11. The activated alumina 15 is therefore reproduced (desorbed) to the initial state at a high reproduction efficiency. Accordingly, adsorption/separation highly dependable on the physical and chemical adsorptive force of an adsorbent material is executed.

When passing the pipe 17 and radiator section 21*a*, this desorbed refrigerant is cooled by heat exchange with the outside air and the radiator section 21*a*, and is liquefied. The liquefied refrigerant is reserved in the tank 20 and the refrigerant mainly containing the "R-114" is separated from the mixed refrigerant in the refrigeration cycle circuit 1. According to the experiments conducted, an "R-114" component initially having 47 mol% and refined to have 98 mol% was reserved in the tank 20.

Conducting the above separating step changes the composition of the mixed refrigerant that circulates in the refrigeration cycle circuit 1 to have an "R-22" component whose concentration is significantly increased from the initial one. According to the experiments, the concentration of the "R-22" component of the mixed refrigerant circulating in the refrigeration cycle circuit 1 increased to 86 mol% in 30 minutes and the concentration of the "R-114" component decreased to "14 mol%. The exhausting temperature of the enclosed compressor 2 (corresponding to the condensing temperature), which was about 90° C. in high temperature operation, decreased to about 50° C. by the change in composition after 30 minutes.

In the above manner, the refrigeration cycle apparatus changes its operation to a high efficiency operation in which efficiency is important, from the high temperature operation.

To change the operation to the previous high temperature operation, the electromagnetic valves 28 and 30 should be set to the "open" side to permit the refrigerant in the reservoir tank 20 to flow out in the refrigeration cycle circuit 1.

This refrigeration cycle apparatus can effectively separate a mixed refrigerant based on the PSA method by the one adsorbent tower 11 and reservoir tank 20 alone without a distiller which would otherwise enlarge the apparatus and excess energy. This apparatus can therefore execute a high efficiency operation as well as a high temperature operation while maintaining compactness.

In this case, since the refrigerant separation system is controlled by the PSA method involving an adsorbent material and reservoir means, the amount of the adsorbent material to be filled in the adsorbent tower 11 need not be large in principle. Under the same conditions as given in the aforementioned Published Unexamined Japanese Patent Application No. 62-162853, the amount of the filled adsorbent material should be 120 g in contrast to 976 g disclosed in the document. The reduction in amount of an adsorbent material to be filled permits the adsorbent tower in this invention to have a height in the order of several tens of centimeters.

As the "R-114" component has a high boiling point, an increases in its concentration in the adsorption/separation step may cause a refined gas to be partially liquefied in the adsorbent tower 11. Since the refined gas outlet 13 of the adsorbent tower 11 is located at the bottom of the tower and the reservoir tank 20 is disposed in the downstream of the tower 11, the liquefied refrigerant can be recovered without remaining somewhere in the tower or in the pipe portion.

In addition, since the heat exchanger 21 is used to use heat generated from the "R-114" component at a time of liquefied reservoir to gasify the refrigerant flowing from the gas-liquid separator 6 and remove the heat from the "R-114" component reserved in liquefied form by means of the radiator section 21*a*which is cooled by the vaporization, a heating cycle is formed between the gasified refrigerant and the heat-removed "R-114" component. This can ensure vaporization and condensation of a refrigerant without heat loss and can thus improve the separation efficiency (large adsorptive pressure) and reserving efficiency. Furthermore, even if a large amount of heat is needed to vaporize a liquid-phase refrigerant whose low boiling point component is condensed at a high concentration, the amount of the vaporizing heat can be reduced by an amount corresponding to the condensing heat utilized. According to the experiments, a sufficient adsorptive pressure could be attained by approximately ⅔ of the amount of heat of the heater (about 1 kW) which is conventionally required to vaporize the liquid-phase refrigerant with a condensed low boiling point component.

Referring to FIG. 1, the broken line indicates a second internal heat exchanger 10 such as a radiation panel. The second internal heat exchanger 10 has only to be coupled between A and B in the refrigeration cycle circuit 1 (between A and B should be open in this case). Although omitted in the diagrams for other embodiments to be described later, such a heat exchanger can also be connected in the same manner.

[SECOND EMBODIMENT]

Figure 4:
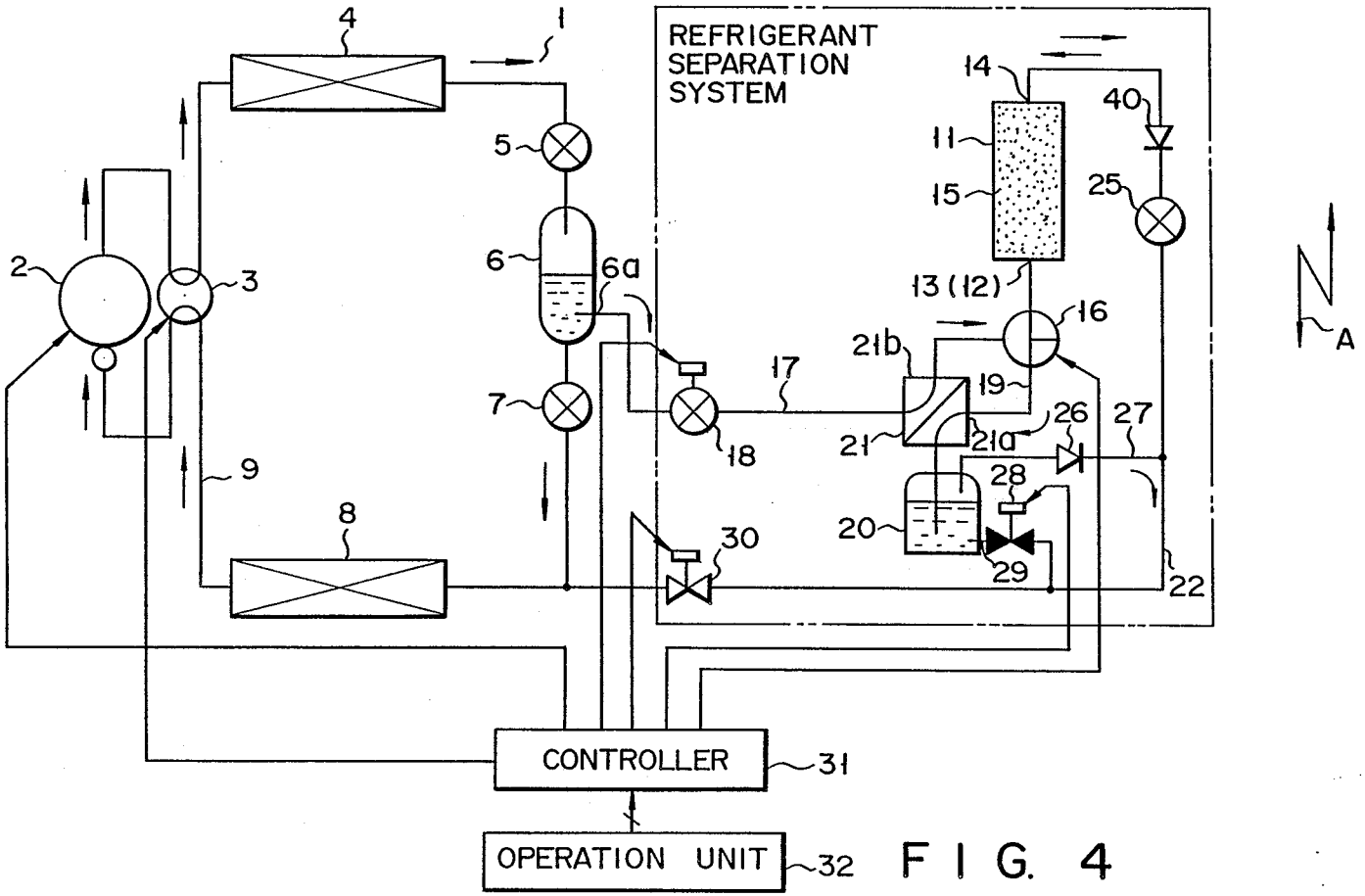
FIG. 4 is a schematic structural diagram illustrating a refrigeration cycle apparatus according to the second embodiment of this invention together with a one tower type refrigerant separation system that is highly dependable on the condensing phenomenon to an adsorbent material which is originated from the difference in refrigerant boiling point.

FIG. 4 illustrates the second embodiment in which this invention is applied to a refrigeration cycle apparatus utilizing an adsorption/separation highly dependable on the condensing phenomenon to an adsorbent material (macro poa) originating from the difference between boiling points of refrigerants.

The refrigeration cycle apparatus of an air conditioner, as illustrated in FIG. 4, has a check valve 40 disposed in the return pipe 22 in place of the purging tank 23 and electromagnetic valve 24 used in the first embodiment. The refrigeration cycle apparatus of the second embodiment is the same as the apparatus of the second embodiment except that the former apparatus does not execute a purging process and repeats adsorption and reproduction simply by condensation and evaporation initiated by the difference in pressure to separate and reserve an "R-114" component.

[THIRD EMBODIMENT]

Figure 5:
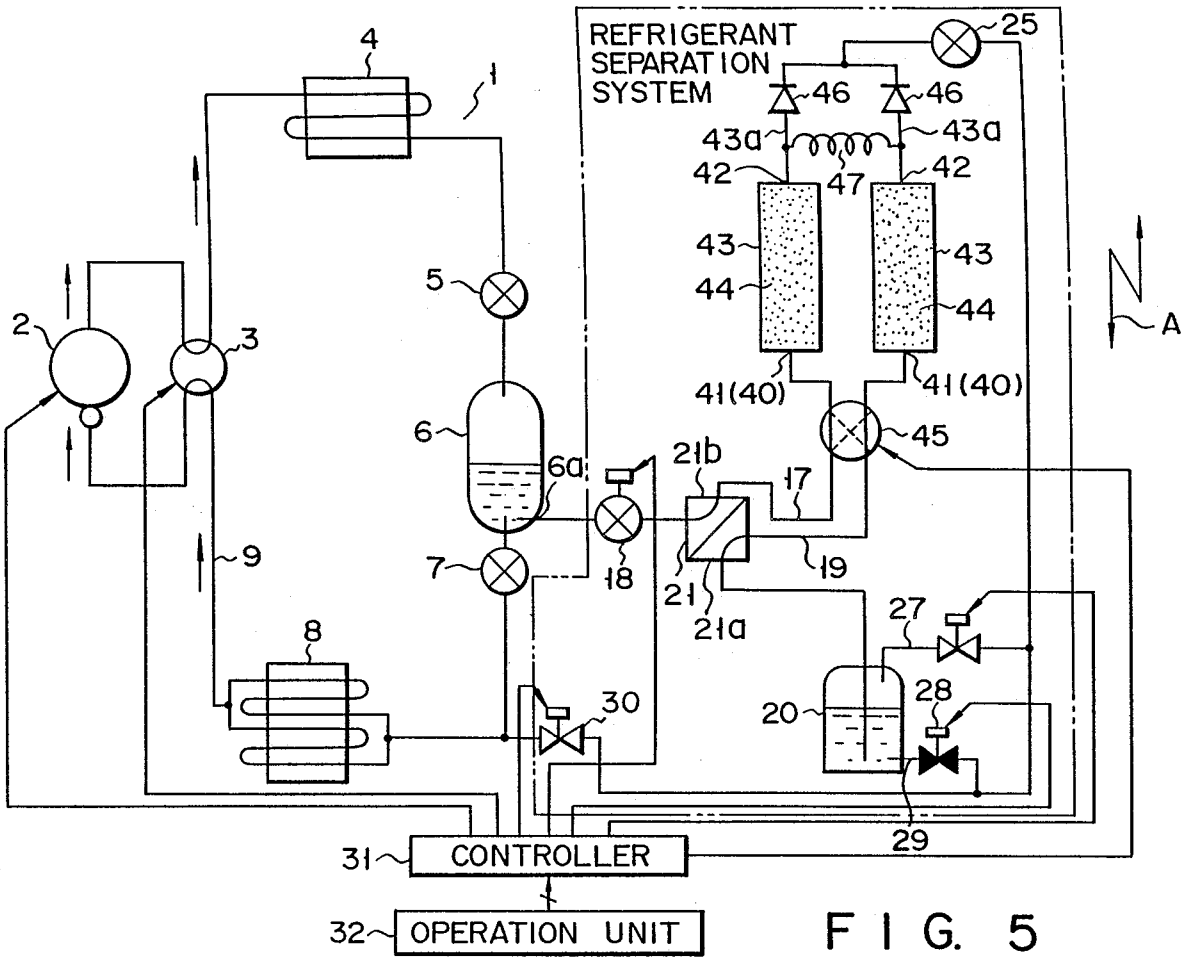
FIG. 5 is a schematic structural diagram illustrating a refrigeration cycle apparatus according to the third embodiment of this invention together with a two tower type refrigerant separation system.

FIG. 5 illustrates the third embodiment of the present invention which, unlike the first and second embodiments, is a refrigeration cycle apparatus equipped with two adsorbent material towers instead of one adsorbent tower 11.

The refrigeration cycle apparatus of an air conditioner, as illustrated in FIG. 5, has a pair of adsorbent towers 43, 43 each having a refined gas outlet 41 serving as a supply gas input 40 at the bottom and an exhaust gas outlet 42 at the top. These adsorbent towers 43, 43 are disposed parallel to each other in the horizontal direction. Each tower 43 is filled with an activated alumina 44 having a main minute aperture diameter of, as per the first and second embodiments.

A mixed refrigerant supply pipe 17 and a refined refrigerant reservoir pipe 19 are connected to the outlet 41 of one of the adsorbent towers 43, 43 via a switching valve 45 constituted by a four-way valve. These pipes 17 and 19 connect the adsorbent towers 43, 43 to a refrigerant reservoir tank 20 disposed in the downstream of thereof. The exhaust gas outlets 42 of the adsorbent towers 43, 43 are connected in parallel to a return pipe 22. Check valves 46 are respectively provided at parallel pipe portions 43*a*, 43*a* linked to the exhaust gas outlets 42. A depressurizing valve 47 serving as a purge resistor is connected between the parallel pipe portions 43*a*, 43*a* so as to permit supply of part of a refined gas inside the adsorbent towers 43 in order to increase the amount of desorbed/reproduced amount. A return regulator 25 serving as a flow regulating resistor is provided in the upstream of the pipe 22, and an electromagnetic valve 30 in the downstream thereof.

When a signal or instructing a composition change is entered through an operation unit 32, the switching valve 45 is alternately switched for every predetermined time so as to permit the adsorbent towers 43 to communicate with a gas-liquid separator 6 and the tank 20.

In other words, according to the third embodiment, while one of the adsorbent towers 43 is being initiated in adsorption, the other tower 43 is being initiated in desorption, so that a refrigerant is separated by this continuous process. It should be understood that the third embodiment has an effect of ensuring a high efficiency operation and a high temperature operation without requiring excess heat and a distiller, as well as effects to recover a liquefied refrigerant without causing it to remain within the towers or pipe portions in the circulation path as per the first embodiment and to execute vaporization and condensation of a refrigerant without heat loss.

The same reference numerals as used for the components of the first embodiment shown in FIG. 1 are used to denote the identical or corresponding elements in the second and third embodiments, thus omitting their description.

Although an activated alumina is used as an adsorbent material for refrigerant separation in the above-described first to third embodiments, the adsorbent material is not restricted to this particular type, but may be zeolite, molecularsieving carbon, activated carbon fiber, activated charcoal, silicagel or the like. According to the experiments, activated alumina, activated charcoal, silicagel or the like having a main minute aperture diameter of 50 to 200 Å serves well to adsorb the "R-114" component by priority.

Although specific numerals are given for the composition of a mixed refrigerant and the target exhaust temperature in the first through third embodiments, they are in no way restrictive figures. Further, the refrigerant reservoir means is not limited to the particular type described in the foregoing description.

As described above, according to the first to third embodiments, the refrigerant separation system can separate a specific type of refrigerant from a mixed refrigerant based on the PSA method using an adsorbent material and reservoir means.

The refrigerant separation system can therefore ensure a high efficiency operation and a high temperature operation without requiring excess heat and a distiller while reducing the amount of a filled adsorbent material as much as possible, thus contributing to realizing a compact refrigeration cycle apparatus and improvement of the operational efficiency.

The first to third embodiments have a further effect such that since the refined gas outlet of the adsorbent material is disposed in the downstream in the gravitational direction and the reservoir means is disposed further downstream, a high boiling point refrigerant even if liquefied can be reserved in the reservoir means without remaining somewhere in its circulation path.

Furthermore, according to the first to third embodiments, the use of the heat exchanging means permits the heat generated from the high boiling point refrigerant at a time of liquefied reservoir to utilize as heat to gasify the liquid-phase refrigerant from the gas-liquid separator. This can increase the adsorptive pressure while suppressing heat loss and can also improve the separation efficiency.

[FOURTH EMBODIMENT]

Figure 6:
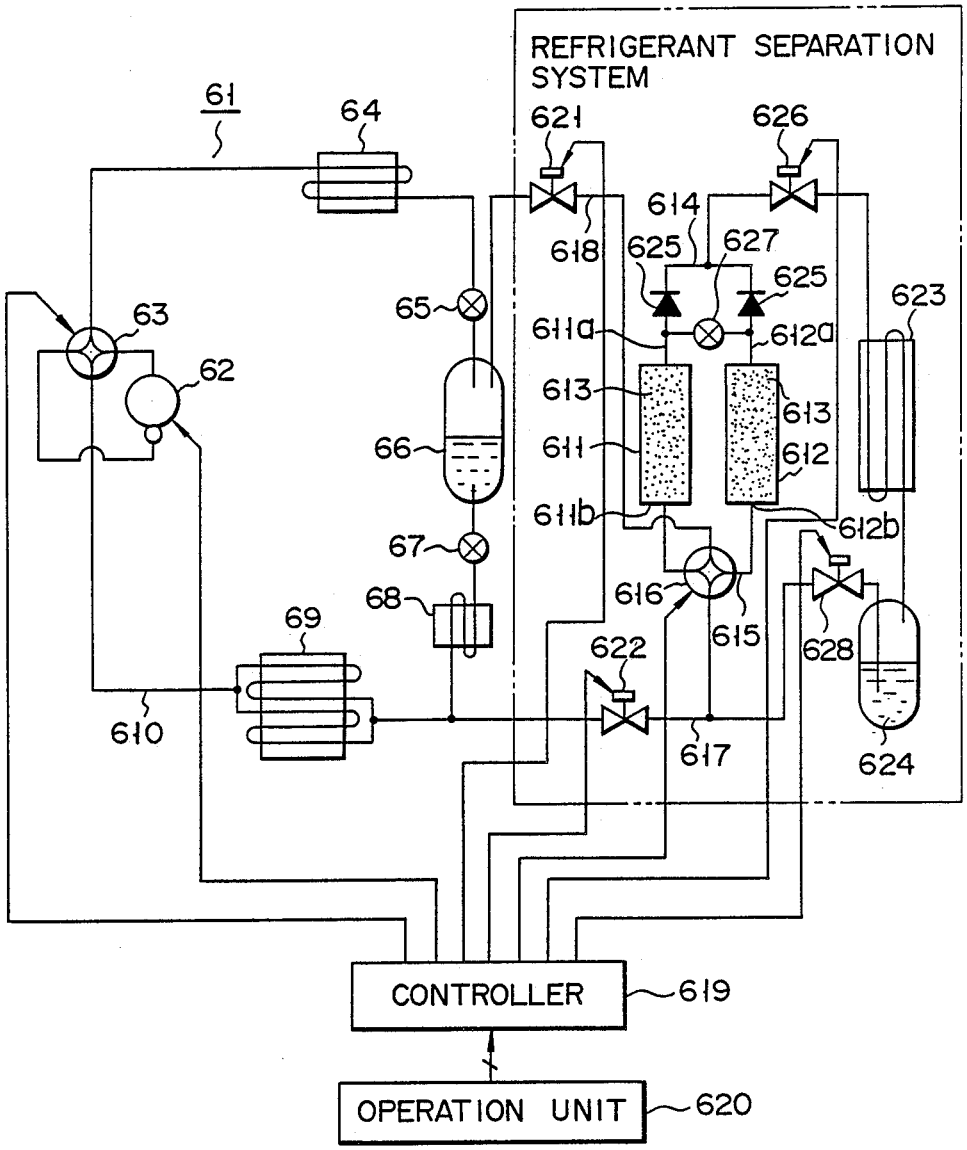
FIG. 6 is a schematic structural diagram illustrating a refrigeration cycle apparatus according to the fourth embodiment of this invention together with a two tower type refrigerant separation system.

The fourth embodiment of the present invention will be described below referring to FIG. 6. FIG. 6 illustrates another refrigeration cycle apparatus of a heat pump type for use in an air conditioner, which apparatus is provided with two adsorbent towers. Reference 61 denotes a refrigeration cycle circuit. This circuit 61 is constituted by connecting a four-way valve 63 for switching between cooling and heating, an internal heat exchanger 64 (corresponding to a condenser), an expansion valve 65 (corresponding to a depressurizing unit), a gas-liquid separator 66, an expansion valve 67 (corresponding to the depressurizing unit), a cooling/reserving heat exchanger 68 and an external heat exchanger 8 (corresponding to a vaporizer) in order to a compressor 62 of, for example, enclosed type through a refrigerant pipe 610. The refrigeration cycle circuit 61 is filled with a mixed refrigerant consisting of, for example, "R-22(84 mol%)" component and "R-114 (16 mol%)" component, the former having a higherconcentration than the latter.

Referring to FIG. 6, numerals 611 and 612 denote a pair of adsorbent towers (corresponding to an adsorbent material) constituting a refrigerant separation system. The adsorbent towers 611 and 612 each have inlet/outlet ports 611*a* (or 612*a*) and 611*b* (or 612*b*) at the top and bottom sections. The adsorbent towers 611 and 612 are filled with an activated alumina 15 with a main minute aperture diameter of 100 Å, which serves as an adsorbent to adsorb "R-114" in the mixed refrigerant by priority and has a high balanced adsorption characteristic to "R-114." (FIG. 2 illustrates the balanced adsorption characteristic of the activated alumina 15, showing the "R-114" component in contrast to the "R-22" component.) The inlet/outlet ports 611*a* and 612*a* at the top of the individual adsorbent towers 611 and 612 are connected in parallel to each other through a flow path 614. The inlet/outlet ports 611*b* and 612*b* at the bottom of the individual adsorbent towers 611 and 612 are connected in parallel to each other through a flow path 615. The flow path 615 is connected to a middle of a flow path 617, connected between a heat exchanger 68 and an external heat exchanger 69, via a switching valve 616 constituted by a four-way valve. The switching valve 616 is also connected to a flow path 618 that is connected on the gas side of a gas-liquid separator 66. Switching the switching valve 616 permits a refrigerant on the high pressure side of the refrigeration cycle circuit 61 to be led to one of the adsorbent towers 611 and 612. Accordingly, of the mentioned refrigerants, the "R-114" component is mainly adsorbed by the activated alumina 613. Also, the adsorbent tower 611 or 612 is depressurized so that the "R-114" component adsorbed by the activated alumina 613 is desorbed and return to the refrigeration cycle circuit 61. The switching valve 616 is connected to a controller 619 (comprising a microcomputer and peripheral circuits), and is switched alternately between a pressurizing side and a depressurizing side for every predetermined time upon reception of a composition-changing instruction signal from an operation unit 620 connected to the controller 619. Reference numerals 621 and 622 are valves respectively disposed in the flow paths 617 and 618.

A heat exchanger 623 for cooling "R-22" and a refrigerant reservoir tank 624 (corresponding to the reservoir means) are sequentially connected to the flow path 614. This arrangement permits that refrigerant "R-22" which has not been adsorbed by the activated alumina 613 in the adsorbent towers 611 and 612, to be liquefied and reserved in the tank 624. Reference numeral 625 is a check valve for preventing the reverse flow from the outlet side of each tower which is connected to the flow path 614. Reference 626 is a valve provided a flow path portion which connects the flow path 614 and the heat exchanger 623. Referring to FIG. 6, a depressurizing valve 627 serving as a purge resistor is connected in parallel between the inlet/outlet ports 611*a* and 611*b* and the individual check valves 625, so that the pressure inside the adsorbent tower 611 or 612 can be increased to increase the amount of the balanced adsorption of the activated alumina 613.

The flow path 617 is connected to a gas outlet portion of the reservoir tank 624, with a valve 628 being coupled to the flow path 617 (see FIG. 6). Opening this valve 628 permits the "R-22" component reserved in liquefied form in the reservoir tank 624 to flow out to the refrigeration cycle circuit 61.

The controller 61 is also coupled with the enclosed type compressor 62, four-way valve 63, and valves 621, 622, 626 and 628, and controls the individual units in the desired statuses in accordance with setting data input from the operation unit 620.

In executing a high efficiency (performance) heating operation with the high-concentration "R-22" component having the aforementioned composition ratio through manipulation of the operation unit 620 in the above refrigeration cycle apparatus of an air conditioner, the valves 621 and 622 are set to the "close" side and the four-way valve 63 is set to the heating side in accordance with the setting data entered via the operation unit 620. Then, the enclosed compressor 62 starts functioning so that the refrigerant sent out from the compressor 62 flows through the external heat exchanger 69, heat exchanger 68, gas-liquid separator 66, and internal heat exchanger 64 in the named order. In other words, a heating cycle is formed and a high efficiency operation is performed using a mixed refrigerant with the high 0 concentration "R-22" component having the aforementioned composition ratio.

When the operation unit 620 is operated to change the efficiency-significant operation to a temperature-significant operation, the valves 621 and 622, which have been closed, are set to the "open" side by a command from the controller 619. And, the switching valve 616 is alternately switched for every predetermined period, thereby separating the "R-22" component from the mixed refrigerant that circulates in the refrigeration cycle circuit 61.

With reference to the refrigerant separating step, opening the valves 621 and 622 permits a high pressure from the flow path 618 and a low pressure from the flow path 617 to act on the switching valve 616. A high pressure mixed refrigerant passes through the activated alumina 613 in one of the adsorbent towers, 611, which is set to the pressurizing side by the switching valve 616. As a result, the "R-114" component in the mixed refrigerant is adsorbed by the activated alumina 613 by priority. The activated alumina 613 in the other adsorbent tower 612, which is set to the depressurizing side by the valve 616, is depressurized, and the "R-114" component, which has been adsorbed in the previous adsorbing step, is desorbed from the activated alumina 613, then returns to the refrigeration cycle circuit 61. Such an adsorbing step and a desorbing step are alternately executed between the adsorbent towers 611 and 612, and the refrigerant having "R-22" as a main component is separated from the mixed refrigerant. Since the pressure of the refined refrigerant is introduced in the adsorbent tower 612 through the depressurizing valve 627 to increase the partial pressure therein, the desorbing/reproducing efficiency for the activated alumina 613 is high (see FIG. 2).

According to the experiments, the "R-22" component refined to have its weight by % changed to 94 mol% from 84 mol% was separated.

This refrigerant is cooled by the heat exchanger 623 to be liquefied and reserved in the reservoir tank 624.

Conducting the above separating step changes the composition of the mixed refrigerant that circulates in the refrigeration cycle circuit 61 to have an "R-114" component whose concentration is significantly increased from the initial one, and the operation mode is changed from the previous high efficiency heating operation to a high temperature heating operation. According to the experiments, the concentration of the "R-22" component of the mixed refrigerant circulating in the refrigeration cycle circuit 61 decreased to 52 mol% in 30 minutes and the concentration of the "R-114" component increased to "48 mol%. The exhausting temperature of the enclosed compressor 62 (corresponding to the condensing temperature), which was about 50° C. in high efficiency operation, increased to about 87° C. by the change in composition after 30 minutes, thus achieving a high temperature operation.

This refrigeration cycle apparatus of the fourth embodiment can effectively separate a mixed refrigerant based on the PSA method by the two adsorbent towers 611, 612 and reservoir tank 624 alone without requiring excess heat and a distiller which would other wise enlarge the apparatus and need excess energy. This apparatus can therefore execute a high efficiency operation as well as a high temperature operation while maintaining compactness, as per the first embodiment.

The amount of a filled adsorbent material and the height of the adsorbent towers in the fourth embodiment can be the same as those mentioned in the description of the first embodiment.

To change the operation to a high efficiency operation from a high temperature operation, the valve 628 has only to be opened so as to permit the refrigerant in the reservoir tank 624 to flow through the refrigeration cycle circuit 61.

[FIFTH EMBODIMENT]

Figure 7:
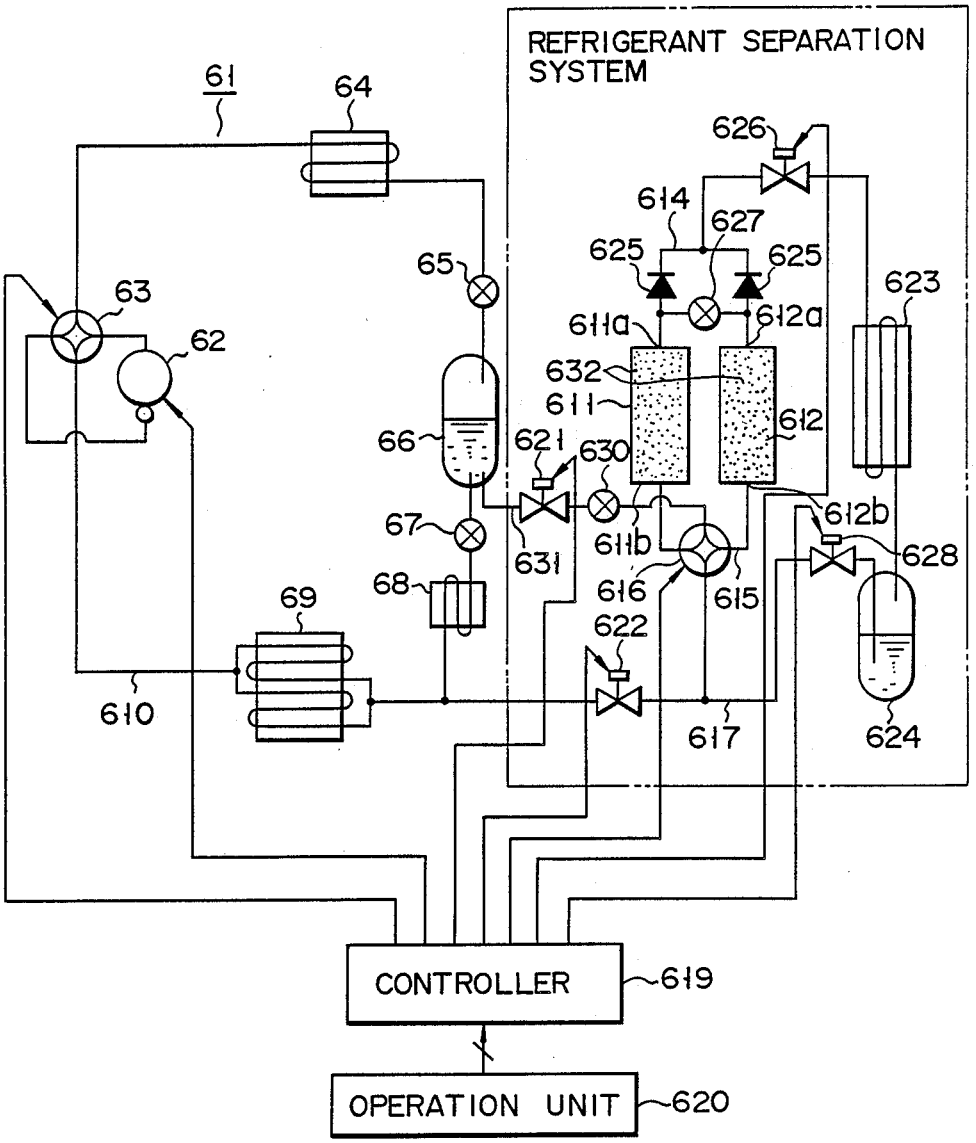
FIG. 7 is a schematic structural diagram illustrating a refrigeration cycle apparatus according to the fifth embodiment of this invention.
Figure 8:
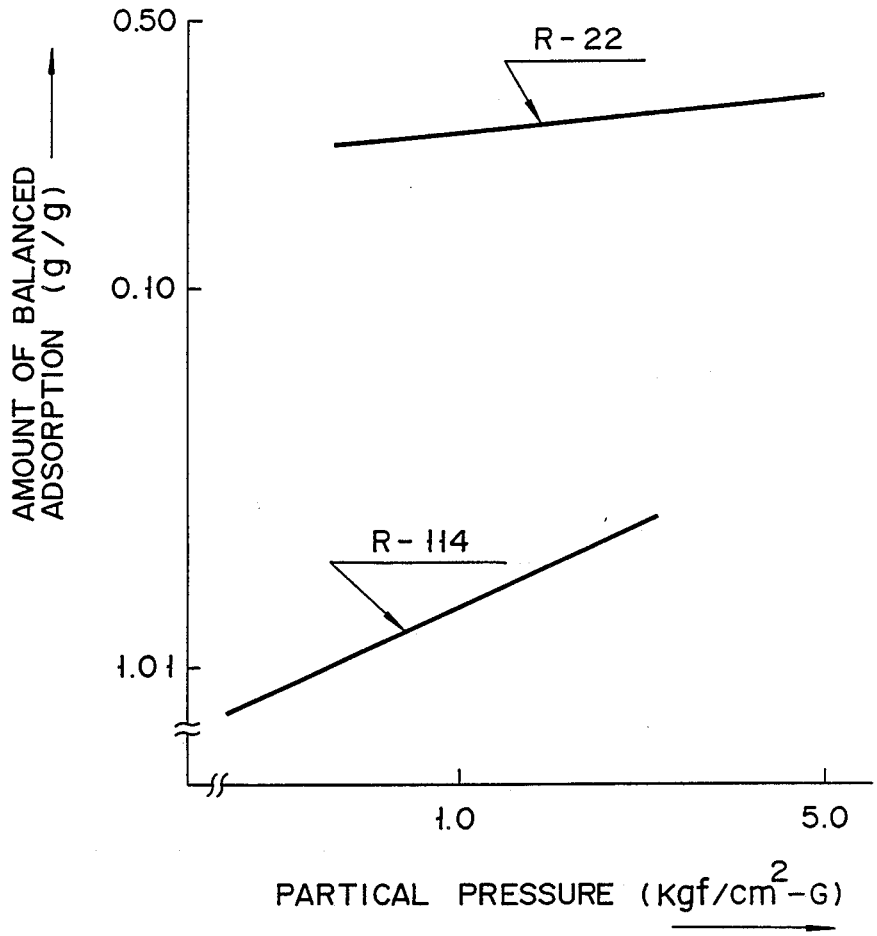
FIG. 8 is a linear diagram illustrating an adsorption characteristic of an A type zeolite filled in the adsorbent towers shown in FIG. 7.

FIGS. 7 and 8 illustrate the fifth embodiment of the invention, in which the invention is applied to a mixed refrigerant for use in an air conditioner that functions to vary the composition of a mixed refrigerant by decreasing the concentration of the "R-114component while increasing the concentration of the "R-22" component, in con-trast to the fourth embodiment.

The refrigeration cycle apparatus of the air conditioner shown in FIG. 7 has the same arrangement as that of the fourth embodiment except that the refrigeration cycle circuit 61 is filled with a mixed refrigerant consisting of an "R-22" component of 53 mol% and an "R-114" component of 47 mol%, the liquid side of the gas-liquid separator 66 is connected through an expansion valve 630 to a flow path 631 to thereby permit the mixed refrigerant on the high pressure side to be introduced in gaseous form to the adsorbent tower 611 or 612, an A type zeolite 632 with a main minute aperture diameter of 4 to 5 Å for adsorbing the "R-22" component of the mixed refrigerant by priority is used as an adsorbent for the adsorbent towers 611, 612, and the heat exchanger 623 is used for cooling the "R-114" component. Accordingly, the same reference numerals as used for these elements in the foregoing description of the fourth embodiment will be used in the following description of the fifth embodiment, and their otherwise redundant description will be omitted.

A high temperature operation is executed in the same manner as the high efficiency operation performed in the fourth embodiment. When an instruction for a high efficiency (performance) operation is given via the operation unit 620 to change the operation to this mode, the valves 621, 622 are opened and the switching valve 616 is alternately switched between the high pressure side and low pressure side in a high temperature operation, thus separating a refrigerant containing "R-114" as a main component from the mixed refrigerant. Subsequently, a refrigerant having the separated "R-114" as a main component is cooled for liquefaction by the heat exchanger 623 and is reserved in the reservoir tank 624. According to the experiments, the "R-114" component refined to have its weight by % changed to 98 mol% from 53 mol% was reserved in the tank 624.

FIG. 8 illustrates a balanced adsorption characteristic of zeolite with respect to "R-22" and "R-114."

In contrast to the fourth embodiment, conducting the above separating step in the fifth embodiment changes the composition of the mixed refrigerant that circulates in the refrigeration cycle circuit 61 to have an "R-22" component whose concentration is significantly increased from the initial one to a level suitable for a high efficiency heating operation. According to the experiments, the concentration of the "R-22" component of the mixed refrigerant circulating in the refrigeration cycle circuit 61 increased to 84 mol% in 30 minutes and the concentration of the "R-114" component decreased to "16 mol%. The exhausting temperature of the enclosed compressor 62, which was about 90° C. in high temperature operation, decreased to about 50° C. by the change in composition after 30 minutes.

To change the operation to the high temperature operation, the valve 628 should be opened to permit the refrigerant in the reservoir tank 624 to flow out in the refrigeration cycle circuit 61.

In other words, even if the operation status is changed as in the fifth embodiment in the reverse direction to the transient direction in the fourth embodiment, the same function as given by the fourth embodiment can be provided.

[SIXTH EMBODIMENT]

Figure 9:
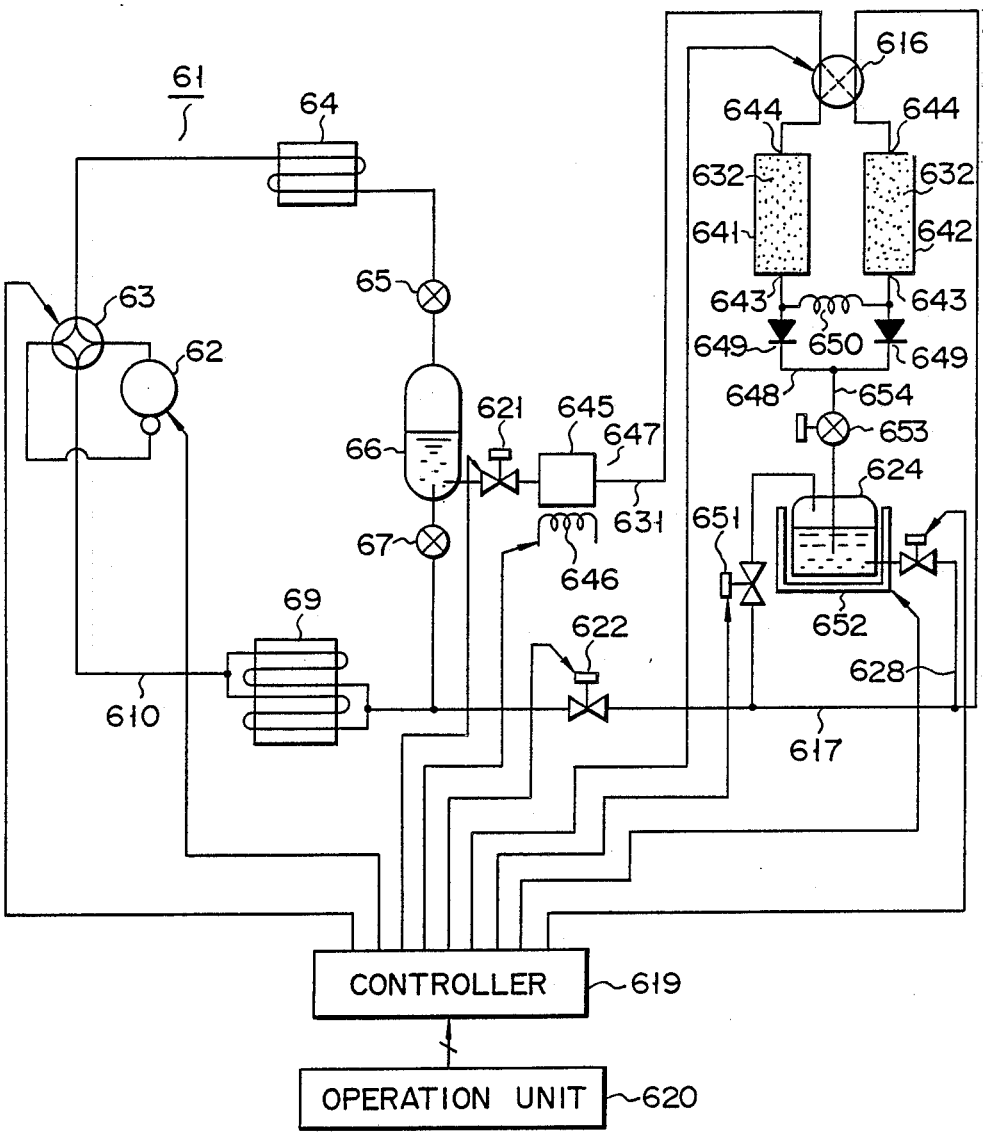
FIG. 9 is a schematic structural diagram illustrating a refrigeration cycle apparatus according to the sixth embodiment of this invention.

FIG. 9 illustrates the sixth embodiment of the invention, which is a modification of the fifth embodiment in which, as described earlier, the "R-22" (low boiling point refrigerant) is adsorbed by zeolite and a refrigerant having the "R-114" (high boiling point refrigerant) as a main component which passes through the zeolite without being adsorbed is separated and reserved in the reservoir tank. The initial composition ratio of the mixed refrigerant is the same as the one in the fifth embodiment.

The refrigeration cycle apparatus of an air conditioner, as illustrated in FIG. 9, has a pair of adsorbent towers 641, 642 each having a refined gas outlet 643 at the bottom and a supply gas inlet 644 serving as a return port at the top. These adsorbent towers 641, 642 are disposed parallel to each other in the horizontal direction. Each tower 641, 642 is filled with a zeolite 632 having a main minute aperture diameter of 5 Å, as per the fifth embodiment.

Flow paths 617 and 631 are connected to the supply gas inlets 644 of the individual adsorbent towers 641, 642 via a switching valve 616 constituted by a four-way valve. This arrangement can permit a mixed refrigerant to be supplied from the upstream of the adsorbent towers 641, 642 and permits the "R-22" component adsorbed by the zeolite 632 to return to the refrigeration cycle circuit 61. In place of the expansion valve 630, heating means for effectively gasify a liquid-phase refrigerant to increase the pressure, namely, a heating unit 647 constituted by a tank 645 and a heater 646 for heating the tank 645 is provided in the flow path 631.

A refrigerant reservoir tank 624 is provided in the downstream (downward in the gravitational direction) of the adsorbent towers 641, 642. The top of the tank 624 is connected to a flow path 648, connecting the adsorbent towers 641, 642 in parallel, via a flow path 654 in which a flow regulator 653 (flow rate regulating resistor). With the above arrangement, a high boiling point refrigerant which has its concentration increased around the refined gas outlet 643 to be liquefied, can be led to the reservoir tank 624 by gravitational free fall.

Referring to FIG. 9, numeral 649 is a check valve for preventing the reverse flow from the refined gas outlet side, numeral 650 is a purge resistor connected to the flow path portion between the check valve 649 and the refined gas outlet 643 for supplying a refined gas to the adsorbent towers 641, 642 (i.e., for increasing the desorbing/reproducing efficiency of the zeolite 32), numeral 651 is a return flow path for returning a gas component in the tank 624 to the refrigeration cycle circuit 61, and numeral 652 is a cooler for cooling the tank 624.

According to thus constituted refrigeration cycle apparatus of the air conditioner, when an instruction to set the operation to a high efficiency mode is given via the operation unit 620, the switching valve 616 is switched for every predetermined time under the control of the controller 619 to alternately switch the adsorbent towers 641 and 642 between the pressuring side and depressurizing side. On the pressurizing side to which one of the towers 641, 642 is set, a high pressure gas of a mixed refrigerant having a low concentration "R-22" component and a high concentration "R-114" component, gasified by the heat from the heating unit 647, is supplied to the inlet 644 from the upstream of the gravitational direction.

The low boiling point refrigerant consisting of the "R-22" component is sequentially adsorbed by the zeolite 632. Around the refined gas outlet, the concentration of that high boiling point refrigerant of the refined gas passing the zeolite 632 which consists of the "R-114" component is increased and this refrigerant is partially liquefied. The liquefied "R-114" component is falls by the gravitation from the refined gas outlet 643 and flows in the reservoir tank 624, passing through the check valve 649 and flow path 654, and it is then liquefied by the cooler 652 for reservoir in the tank.

On the depressurizing side to which the other one of the towers 641, 642 is set, a refrigerant mainly consisting of "R-22" adsorbed by the zeolite 632 in the above process returns to the low pressure side of the refrigeration cycle circuit 61, passing through the switching valve 616 and flow path 617, due to the difference in pressure. In other words, the zeolite 632 has the "R-22" component desorbed therefrom and is reproduced to the initial status.

Such an adsorbing step and desorbing step are alternately executed between the adsorbent towers 641 and 642, and a refrigerant mainly consisting of the "R-114" component is separated from the mixed refrigerant to make the mixed refrigerant in the refrigeration cycle circuit 61 to have a composition suitable for a high efficiency (heating) operation, as per the fifth embodiment.

According to the experiments, the "R-114" component refined to have its weight by % changed to 95 mol% from 47 mol% was reserved in the reservoir tank 624. The composition of the mixed refrigerant circulating the refrigeration cycle circuit 61 was changed to be suitable for a high efficiency (heating) operation as the concentration of the "R-22" component was increased to 80 mol% from 53 mol% (initial state) in 30 minutes.

According to the arrangement of the sixth embodiment, the refined gas outlets 643, 643 of the adsorbent towers 641, 642 are provided at the bottom sections thereof, and the reservoir tank 624 is disposed in further downstream of the adsorbent towers so that a liquefied refrigerant is led to the tank by the gravitational force. This arrangement therefore has an advantage of recovering the refrigerant without causing it to remain somewhere in the pipes, etc.

It should be understood that as being similar to the fifth embodiment, those similar or identical to the elements of the fifth embodiment are denoted by the same reference numerals and their explanation has been omitted in the foregoing description.

Although an activated alumina or an A type zeolite is used as an adsorbent for refrigerant separation in the fourth to sixth embodiments, the adsorbent is not restricted to this particular type, but may be molecular sieving carbon, activated carbon fiber, activated charcoal, or the like. According to the experiments, molecular sieving carbon, activated carbon fiber, or the like having a main minute aperture diameter of 50 to 200 Å serves well to adsorb the "R-22" component by priority.

Although specific numerals are given for the composition of a mixed refrigerant and the target exhaust temperature in the fourth through sixth embodiments, they are in no way restrictive figures. Further, the refrigerant reservoir means is not limited to the particular type of these embodiment.

As described above, according to the fourth to sixth embodiments, the refrigerant separation system can separate a specific type of refrigerant from a mixed refrigerant based on the PSA method using an adsorbent material and reservoir means.

The refrigerant separation system can therefore ensure a high efficiency operation and a high temperature operation without requiring excess heat and a distiller, thus contributing to realizing a compact refrigeration cycle apparatus and improvement of the operational efficiency.

Throughout the first to sixth embodiments, "R-114" of a mixed refrigerant consisting of "R-22" and "R-114" may be replaced by "R-123," "R-318" or the like. For instance, a mixed refrigerant having a composition ratio of "R-22"/"R-138"=80 mol%/20 mol% is suitable for high efficiency heating, and a mixed refrigerant having a composition ratio of "R-22"/"R-138"=50 mol%/50 mol% is suitable for high temperature heating (including supplying of hot water).

What is claimed is:

1. A refrigeration cycle apparatus comprising:

refrigeration cycle circuit means for permitting a mixed refrigerant including a high boiling point refrigerant and a low boiling point refrigerant adapted to be filled having a predetermined concentration ratio to circulate at least through a compressor, a condenser and an evaporator to thereby provide a refrigeration cycle of a heat pump type; and refrigerant separating means having adsorbing means for separating one of said high boiling point refrigerant and said low boiling point refrigerant from said mixed refrigerant to be circulated by said refrigeration cycle circuit means by a pressure swing adsorption method, reservoir means for temporarily reserving said refrigerant other than said refrigerant separated by said adsorbing means, and means for returning that remaining refrigerant which is separated by said adsorbing mean and is not reserved by said reservoir means, to said refrigeration cycle circuit means.

2. A refrigeration cycle apparatus according to claim 1, wherein said adsorbing means receives said mixed refrigerant from a high pressure refrigerant side of said refrigeration cycle circuit means, and said returning means returns said remaining refrigerant to a low pressure refrigerant side of said refrigeration cycle circuit means.

3. A refrigeration cycle apparatus according to claim 2, wherein said refrigeration cycle circuit means further includes a gas-liquid separator disposed between said condenser and said evaporator to permits said mixed refrigerant to flow to said adsorbing means of said refrigerant separating means from a predetermined portion of said gas-liquid separator.

4. A refrigeration cycle apparatus according to claim 3, wherein said predetermined portion of said gasliquid separator is on a liquid side.

5. A refrigeration cycle apparatus according to claim 3, wherein said predetermined portion of said gasliquid separator is on a gas side.

6. A refrigeration cycle apparatus according to claim 3, wherein said adsorbing means includes introducing means for selectively introducing said mixed refrigerant, adsorbent tower means filled with an adsorbent material for permitting adsorption and desorption of one of said high boiling point refrigerant and low boiling point refrigerant contained in an introduced mixed refrigerant under a predetermined pressure, and switching means for switching pressure to said adsorbent tower means between a high pressure and a low pressure in a predetermined cycle to permit adsorption by and desorption from said adsorbent material to be alternately repeated.

7. A refrigeration cycle apparatus according to claim 6, wherein said adsorbent tower means has a supply gas inlet and a refined gas outlet commonly in a downstream of a gravitational direction, and an exhaust gas outlet in an upstream thereof.

8. A refrigeration cycle apparatus according to claim 7, wherein said reservoir means is disposed in further downstream of said refined gas outlet of said adsorbent tower means in said gravitational direction.

9. A refrigeration cycle apparatus according to claim 7, wherein said adsorbent tower means is of a one tower type.

10. A refrigeration cycle apparatus according to claim 7, wherein said adsorbent tower means is of a two tower type.

11. A refrigeration cycle apparatus according to claim 7, wherein said returning means includes a purging tank, an electromagnetic valve and a flow regulator connected in order between said exhaust gas outlet of said adsorbent tower means and said refrigeration cycle circuit means.

12. A refrigeration cycle apparatus according to claim 7, wherein said switching means includes a switching valve for setting a first flow path between said supply gas inlet of said adsorbent tower means and said gas-liquid separator in a communicatable state at said time of adsorption and for setting a second flow path between said refined gas outlet of said adsorbent tower means and said reservoir means in a communicatable state at said time of desorption.

13. A refrigeration cycle apparatus according to claim 12, wherein said refrigerant separating means has a heat exchanger comprising a heat receiving section disposed in said first flow path and a radiator section disposed in said second flow path.

14. A refrigeration cycle apparatus according to claim 7, wherein said returning means includes a check valve and a flow regulator connected in order between said exhaust gas outlet of said adsorbent tower means and said low pressure refrigerant side of said refrigeration cycle circuit means.

15. A refrigeration cycle apparatus according to claim 6, wherein said reservoir means reserves that refrigerant which has been adsorbed by said adsorbent material, then is desorbed therefrom.

16. A refrigeration cycle apparatus according to claim 6, wherein said reservoir means reserves that refrigerant which passes said adsorbent material without being adsorbed.

17. A refrigeration cycle apparatus comprising:

a refrigeration cycle circuit having a condenser, a depressurizing unit and an evaporator coupled to a compressor in order and having a non-azeotropic mixed refrigerant consisting of a high boiling point refrigerant and a low boiling point refrigerant filled therein;

an adsorbent material for adsorbing a specific type of refrigerant in said mixed refrigerant;

a first flow path, coupled to a high pressure side of said refrigeration cycle circuit, for leading that mixed refrigerant on said high pressure side to said adsorbent material for adsorption of said specific type of refrigerant;

a second flow path, coupled to said adsorbent material, for returning that refrigerant which passes through said second flow path without being adsorbed, to said refrigeration cycle circuit;

a third flow path, coupled to said adsorbent material, for depressurizing said adsorbent material and desorbing a refrigerant from said adsorbent material;

a switching valve for alternately switching between said first and third flow paths; and reservoir means, coupled to said third flow path, for reserving said desorbed refrigerant.

18. A refrigeration cycle apparatus comprising:

a refrigeration cycle circuit having a condenser, a depressurizing unit, a gas-liquid separator and an evaporator coupled to a compressor in order and having a non-azeotropic mixed refrigerant consisting of a high boiling point refrigerant and a low boiling point refrigerant filled therein;

an adsorbent material for adsorbing said high boiling point refrigerant in said mixed refrigerant;

a refined gas outlet disposed below said adsorbent material, from which refined gas from said adsorbent material flows out;

a first flow path, coupled to said gas-liquid separator, for leading a refrigerant to said adsorbent material for adsorption of said high boiling point refrigerant;

a second flow path, coupled to said adsorbent material, for returning that refrigerant which passes through said second flow path without being adsorbed, to said refrigeration cycle circuit;

a third flow path, coupled to said refined gas outlet of said adsorbent material, for depressurizing said adsorbent material and desorbing said high boiling point refrigerant from said adsorbent material;

a switching valve for alternately switching between said first and third flow paths; and reservoir means, disposed downstream of said adsorbent material, for reserving said high boiling point refrigerant flowing through said third flow path.

19. A refrigeration cycle apparatus comprising:

a refrigeration cycle circuit having a condenser, a depressurizing unit, a gas-liquid separator and an evaporator coupled to a compressor in order and having a non-azeotropic mixed refrigerant consisting of a high boiling point refrigerant and a low boiling point refrigerant filled therein., an adsorbent material for adsorbing said high boiling point refrigerant in said mixed refrigerant., a first flow path, coupled to a liquid outlet of said gas-liquid separator, for leading a liquid-phase refrigerant to said adsorbent material for adsorption of said high boiling point refrigerant;

a second flow path, coupled to said adsorbent material, for returning that refrigerant which passes through said second flow path without being adsorbed, to said refrigeration cycle circuit;

a third flow path, coupled to said adsorbent material, for depressurizing said adsorbent material and desorbing said high boiling point refrigerant from said adsorbent material;

a switching valve for alternately switching between said first and third flow paths;

heat exchanging means having a radiator section provided in said third flow path and a heat receiving section provided in said first flow path in communication with said radiator section, for supplying heat of vaporization to a refrigerant flowing through said first flow path; and reservoir means, coupled to said third flow path, for reserving said desorbed high boiling point refrigerant.

20. A refrigeration cycle apparatus comprising:

a refrigeration cycle circuit having a condenser, a depressurizing unit, a gas-liquid separator and an evaporator coupled to a compressor in order and having a non-azeotropic mixed refrigerant consisting of plural types of refrigerants filled therein;

an adsorbent material for mainly affecting a specific type of refrigerant of said mixed refrigerant., a first flow path for leading that refrigerant on a high pressure side of said refrigeration cycle circuit to said adsorbent material for adsorption of said specific type of refrigerant;

a second flow path for permitting said adsorbent material to communicate with a low pressure side of said refrigeration cycle circuit, desorbing a refrigerant from said adsorbent material through depressurization, and returning said desorbed refrigerant to said refrigeration cycle circuit;

a switching valve for alternately switching between said first and second flow paths; and means, coupled to said adsorbent reservoir material, for reserving that type of refrigerant which is not adsorbed by said adsorbent material.

* * * * *